US005585806A

United States Patent [19]

Ogino et al.

[11] Patent Number: 5,585,806

[45] Date of Patent: Dec. 17, 1996

[54] FLAT ANTENNA APPARATUS HAVING A SHIELDED CIRCUIT BOARD

[75] Inventors: Toshikazu Ogino; Ryoji Yamamoto; Hideo Yajima, all of Atsugi, Japan

[73] Assignee: Mitsumi Electric Co., Ltd., Tokyo, Japan

[21] Appl. No.: 364,746

[22] Filed: Dec. 27, 1994

[30] Foreign Application Priority Data

| | | | |
|---|---|---|---|
| Dec. 28, 1993 | [JP] | Japan | 5-070721 U |
| Feb. 28, 1994 | [JP] | Japan | 6-054937 |
| Feb. 28, 1994 | [JP] | Japan | 6-054938 |

[51] Int. Cl.[6] ..... H01Q 1/38

[52] U.S. Cl. ..... 343/700 MS; 343/702; 343/841; 343/906; 439/610

[58] Field of Search ..... 343/700 MS, 702, 343/713, 841, 872, 906; 439/76.1, 98, 610

[56] References Cited

U.S. PATENT DOCUMENTS

| | | | |
|---|---|---|---|
| 4,803,491 | 2/1989 | Hikuma | 343/702 |
| 4,955,084 | 9/1990 | Umetsu et al. | 343/702 |
| 5,145,409 | 9/1992 | Sato et al. | 439/610 |
| 5,171,161 | 12/1992 | Kachlic | 439/610 |
| 5,425,657 | 6/1995 | Davis et al. | 439/610 |
| 5,428,362 | 6/1995 | Chatzipetros et al. | 343/700 MS |

FOREIGN PATENT DOCUMENTS

| | | |
|---|---|---|
| 61-158707 | 10/1986 | Japan . |
| 61-274402 | 12/1986 | Japan . |
| 2-35803 | 2/1990 | Japan . |
| 3-238903 | 10/1991 | Japan . |
| 4-76703 | 7/1992 | Japan . |

*Primary Examiner*—Donald T. Hajec
*Assistant Examiner*—Tan Ho
*Attorney, Agent, or Firm*—Michael N. Meller

[57] ABSTRACT

There is provided a flat antenna apparatus in which a low-noise amplifier provided therein does not generate an abnormal oscillation, and a case and a ground pattern formed on a circuit board are reliably connected to each other by means of a simple construction. A flat antenna element is mounted on a circuit board. The circuit board has an amplifying circuit for amplifying a radio frequency received from the flat antenna element. A case and the flat antenna element are attached to opposite sides of the circuit board. A tab formed on a peripheral edge of the case is inserted into a slot formed on the circuit board, the tab being soldered to fix the case on the circuit board.

10 Claims, 7 Drawing Sheets

FLAT ANTENNA APPARATUS HAVING A SHIELDED CIRCUIT BOARD

BACKGROUND OF THE INVENTION

The present invention generally relates to a flat antenna apparatus, and more particularly to a flat antenna apparatus which receives a radio frequency by using a flat antenna element generally used for a Global Positioning System (GPS).

The GPS used for, for example, a car navigation system utilizes a radio frequency transmitted by a plurality of GPS satellites to the ground so as to locate a current position (latitude, longitude and altitude) of a moving object. The GPS generally comprises an antenna unit, a receiving unit, a signal processing unit and a display unit.

A radio frequency in a Giga-Hertz band transmitted by the satellites is received by the antenna unit. The received radio frequency is amplified by a low noise amplifier, and thereafter supplied to the receiving unit as a received signal. The receiving unit demodulates the signal supplied by the antenna unit, and supplies it to the signal processing unit. The signal processing unit performs a signal processing by using the demodulated signal received from the receiving unit. The display unit displays on a map a result of a position determination in accordance with the signal processing.

FIG. 1 is a side view of a conventional flat antenna apparatus 10.

The flat antenna apparatus 10 comprises a flat antenna element 11, a circuit board 14 and a mounting board 15. The flat antenna element 11 is formed by attaching a patch antenna 13 made of a gold plated copper plate to a bottom surface of a board 12 made from a fluorocarbon resin. The flat antenna element 11 is fixed on a bottom surface of the mounting board 15 by an adhesive tape.

A low-noise amplifier is mounted on the circuit board 14 which low-noise amplifier is connected to the patch antenna 13. The low-noise amplifier amplifies a received radio frequency supplied by the patch antenna 13. The circuit board 14 is placed on top of the mounting board 15 which is made of a metal, and fixed to a bottom surface thereof by an adhesive. FIG. 2 is a perspective view showing a positional relationship between the antenna 11, the mounting board 15 and the circuit board 14. It should be noted that the drawing of FIG. 2 is illustrated upside down relative to FIG. 1

The mounting board 15 is grounded so as to shield the flat antenna element 11 and circuit board 14. Additionally, a coaxial cable 18 is provided for connecting the low-noise amplifier mounted on the circuit board 14 to an external receiving unit.

In the above-mentioned flat antenna apparatus, the mounting board 15 is surrounded by a metal case 16, and a cover 17 is attached thereon so as to cover the circuit board 14. Accordingly, a shielding effect is obtained by providing the mounting board 15 made of a metal while the good mountability of the metal case 16 is maintained.

In the flat antenna apparatus 10, since the circuit board 14 and the mounting board 15 are placed on top of each other, a gap is formed therebetween when the circuit board 14 or the mounting board 15 is warped. In this condition, the low-noise amplifier which has a high gain may have a drift capacity, and thus there is a problem in that an abnormal oscillation is generated in the low-noise amplifier.

In the flat antenna apparatus 10, the case 16 is electrically connected to the circuit board 14. That is, the case 16 is connected to a ground pattern 14*a* formed on the circuit board 14 so as to eliminate an external noise via the case 16. This electrical connection is performed by means of a soldering at a predetermined position as shown in FIG. 3. The soldering operation is performed while abutting a solder iron against an inner wall of the case 16. After the soldering operation is finished, the cover 17 is attached to the case 16.

In order to perform the above-mentioned soldering operation, the case 16 and the cover 17 are formed as separate parts. Accordingly, the number of parts and the number of assembling processes of the flat antenna apparatus 10 are increased, and thus there is a problem in that a manufacturing cost of the flat antenna apparatus 10 is increased. Additionally, since the soldering operation is inconvenient, a reliable soldering may not be performed.

In FIG. 1, the coaxial cable 18 is fixed on an extending portion 14*b* of the circuit board 14 which extending portion extends outwardly from the circuit board 14. More specifically, a mounting portion 19 is provided in an area from which the coaxial cable 18 extends so that the mounting portion 19 pinches a shield conductor 18*b* of the coaxial cable 18. A core wire 18*c* of the coaxial cable 18 is soldered to the circuit board 14. The coaxial cable 18 is fixed to the extending portion 14*b* by using a fastener 20 which is a part separate from the circuit board 14 and the mounting board 15. The fastener 20 is fixed on the extending portion 14*b* of the circuit board 14 by means of screws 20*a*.

As mentioned above, in the conventional flat antenna apparatus 10, the coaxial cable 18 is fixed to the extending portion 14*a* by the fastener 20 and the fastener 20 is fixed on the extending 14*a* of the circuit board 14 by means of the screws 20*a*. Accordingly, the number of parts and the number of assembling processes are increased, and thus there is a problem in that a manufacturing cost of the flat antenna apparatus 10 is increased.

SUMMARY OF THE INVENTION

It is a general object of the present invention to provide an improved and useful flat antenna apparatus in which the above-mentioned problems are eliminated.

A more specific object of the present invention is to provide a flat antenna apparatus in which a low-noise amplifier provided therein does not generate an abnormal oscillation.

Another object of the present inventing is to provide a flat antenna apparatus in which a case and a ground pattern formed on a circuit board are reliably connected to each other by means of a simple construction.

Another object of the present invention is to provide a flat antenna apparatus in which a coaxial cable is fixed by means of a simple construction.

In order to achieve the above-mentioned objects, there is provide according to one aspect of the present invention a flat antenna apparatus comprising:

a flat antenna element;

a circuit board having an amplifying circuit for amplifying a radio frequency received from the flat antenna element, the flat antenna element being mounted on said circuit board;

a case, positioned on the circuit board, being made of a conductor so that the amplifying circuit is shielded; and attaching means for directly attaching the case to the circuit board without having a mounting member, wherein the case is attached on an opposite side of the flat antenna element relative to the circuit board.

According to the present invention, the circuit board is directly connected to the case, that is, it is not placed, as is the conventional apparatus, on top of a metal mounting plate which is grounded. Additionally, electric parts comprising a low-noise amplifier are shielded by being accommodated in the case. Accordingly, if a warp is generated in the circuit board, a drifting capacity is not generated in the low-noise amplifier because the grounded case is sufficiently apart from the low-noise amplifier. Thus, a possibility that an abnormal oscillation will be generated is eliminated. Additionally, since the number of parts and the number of assembling processes are decreased by eliminating the mounting board made of a metal plate, a low cost flat antenna apparatus can be obtained.

Additionally, there is provided according to another aspect of the present invention a mounting construction of a connecting cable connecting a device accommodated in a case for electric circuit to a device located outside the case, the mounting construction comprising:

an opening formed on a side wall of the case, the connecting cable passing through said opening;

a protruding portion extending outwardly along the connecting cable being formed on the side wall, the connecting cable being fastened to the protruding portion.

According to the above-mentioned mounting construction of a connecting cable, since the connecting cable can be fixed to the case by means of a simple construction, the number of parts and the number of assembling processes are decreased, resulting in a reduction in manufacturing costs.

Other objects, features and advantages of the present invention will become more apparent from the following detailed description when read in conjunction with the accompanying drawings.

DETAILED DESCRIPTION OF THE PREFERRED EMBODIMENTS

A description will now be given of an embodiment according to the present invention.

Figure 1:
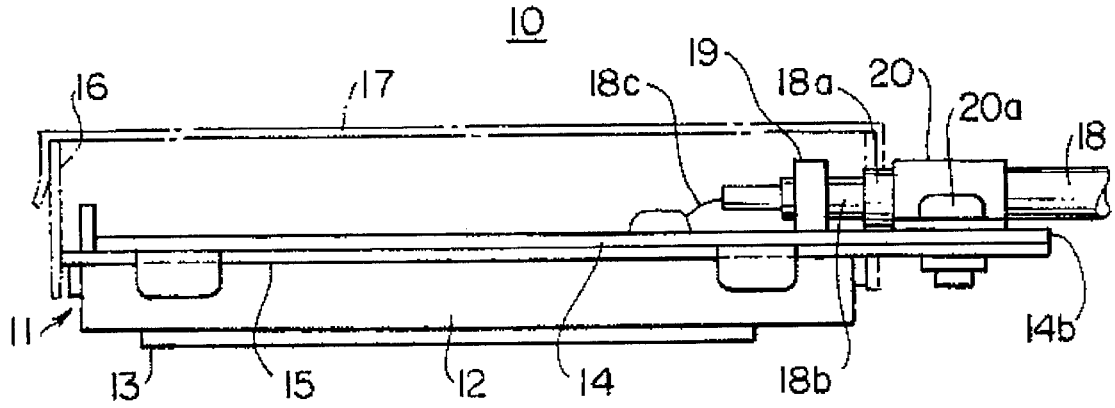
FIG. 1 PRIOR ART
FIG. 1 is a side view of a conventional flat antenna apparatus.
Figure 3:
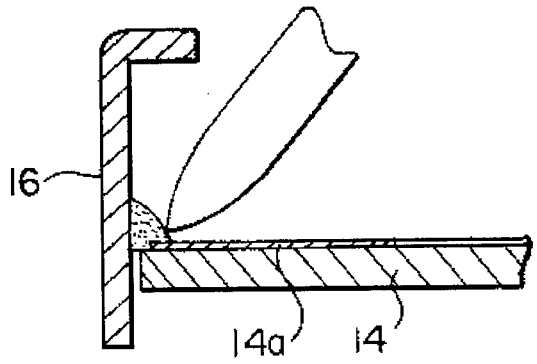
FIG. 3 PRIOR ART
FIG. 3 is an illustration showing a soldering operation performed to assemble the conventional flat antenna apparatus shown in FIG. 1.
Figure 2:
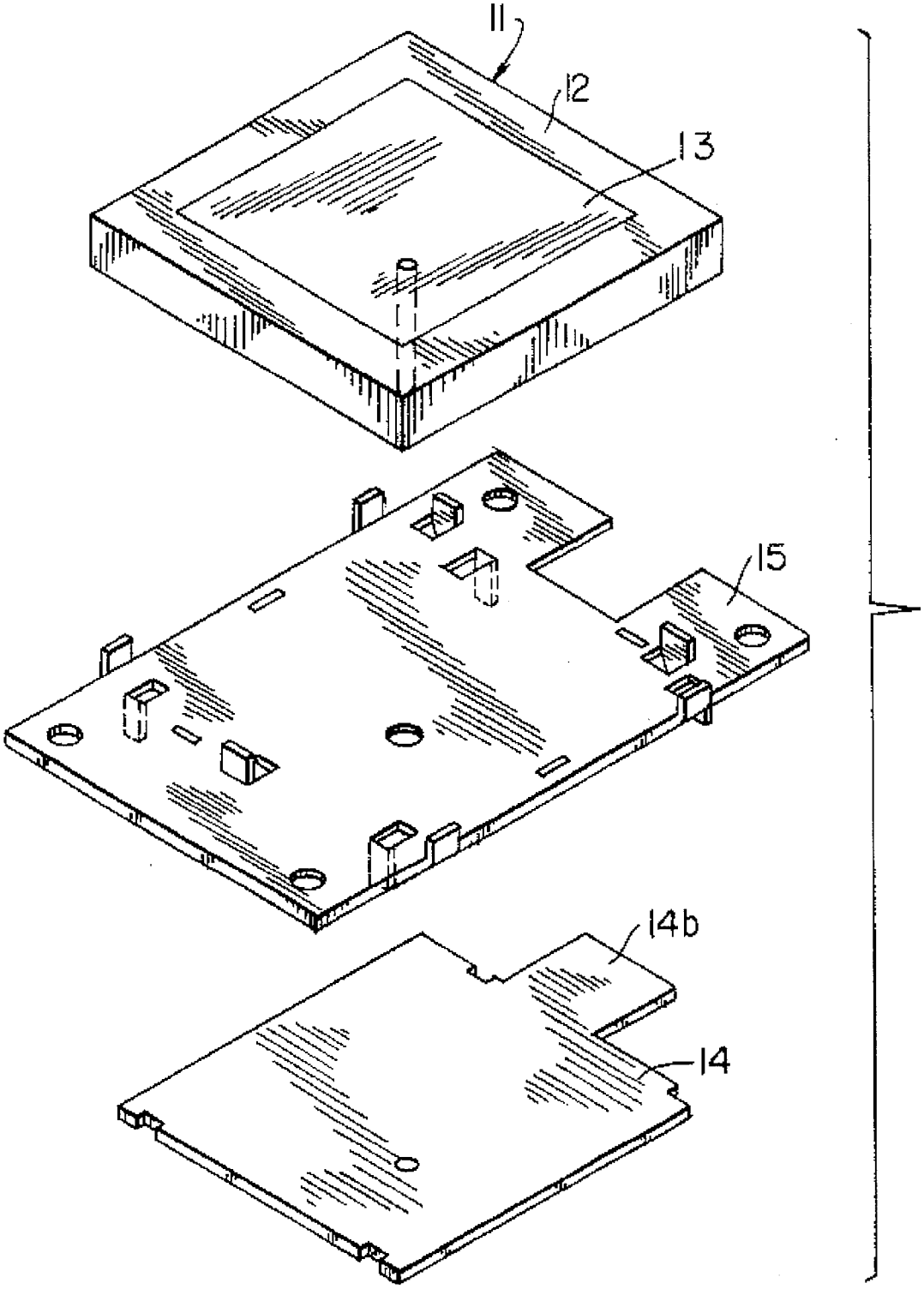
FIG. 2 PRIOR ART
FIG. 2 is an exploded perspective view of a part of the conventional flat antenna apparatus shown in FIG. 1.
Figure 4:
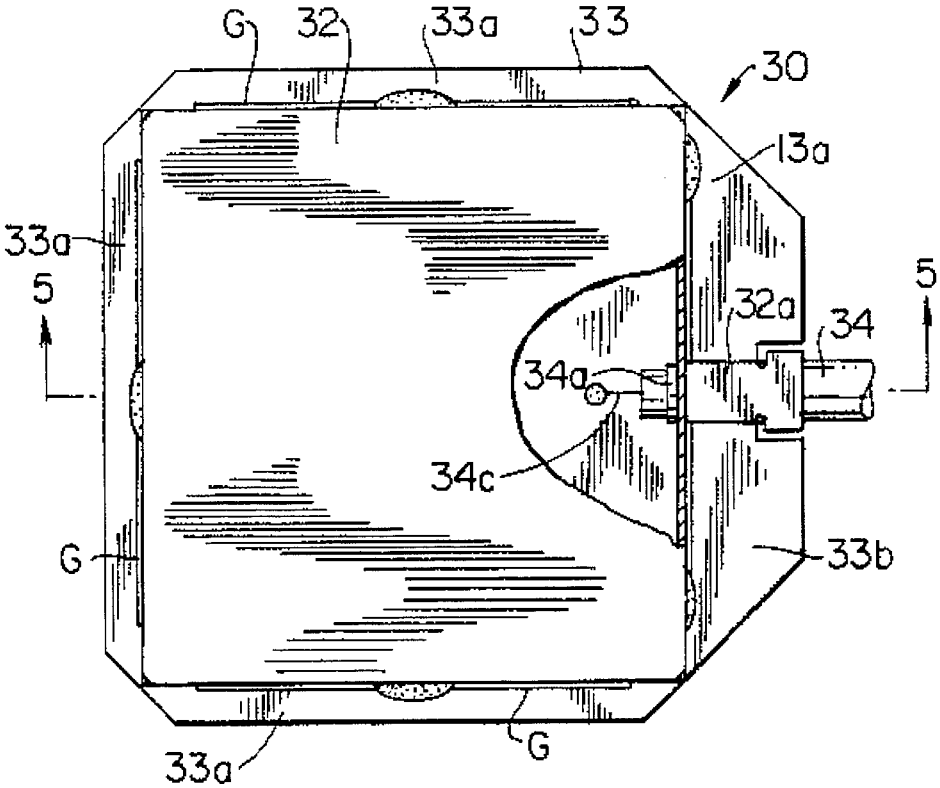
FIG. 4 is a partially cut-away view of an embodiment of a flat antenna apparatus according to the present invention.
Figure 5:
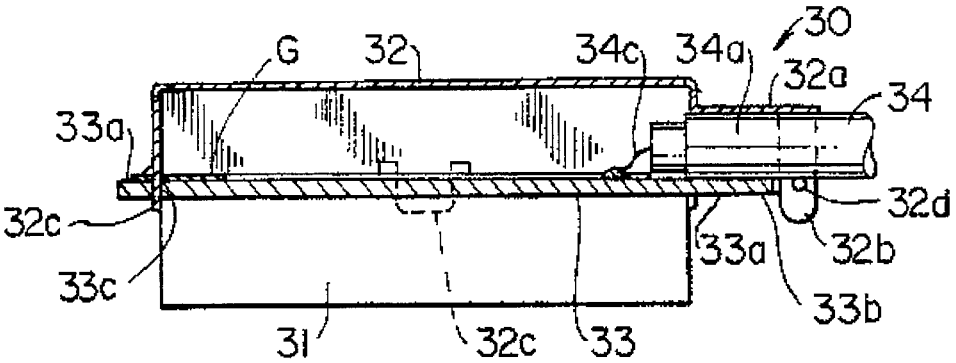
FIG. 5 is a cross-sectional view of the flat antenna apparatus shown in FIG. 4.
Figure 6:
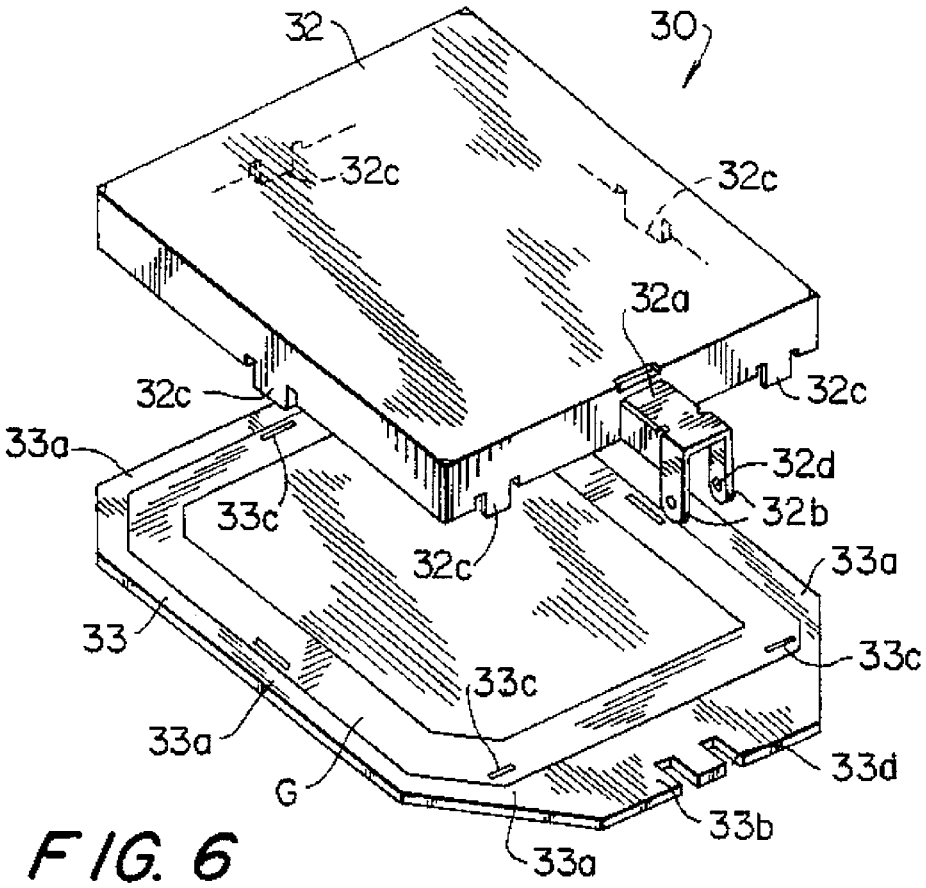
FIG. 6 is an exploded perspective view of the flat antenna apparatus shown in FIG. 4.

FIGS. 4, 5 and 6 show an embodiment of a flat antenna apparatus 30 according to the present invention.

The flat antenna apparatus 30 shown in FIGS. 4, 5 and 6 comprises a circuit board 33 on which a flat antenna element 31 is mounted, a case 32 covering the circuit board 33 and a coaxial cable 34 connected to a connecting portion provided as an output terminal of the circuit board 33. A circuit for processing a signal received by the flat antenna element 31 is formed on the circuit board 33. The cover 32 is formed of a conductor such, as a plated steel plate, so as to shield the circuit formed on the circuit board 33.

Four corners of the circuit board 33 are cut, and the circuit board 33 is formed in a size larger than a size of the case 32 so that extending portions 33*a* and 33*b* are formed. The extending portion 33*b* extends farther than the extending portion 33*a*. A ground pattern G is formed, as shown in FIG. 6, on the circuit board 33. Electric parts comprising a low-noise amplifier are provided inside the ground pattern G.

The case 32 is formed in a box-like shape having a bottom, one face of the case 32 being open. A portion of a side wall of the case 32, which side wall corresponds to the extending portion 33*a*, is cut and bent to form a protruding portion 32*a*. A pair of claws 32*b* are formed on an extreme end of the protruding portion 32*a*. Additionally, a plurality of tabs 32*c* are formed on edges of side walls of the case 32. The claws 32*c* are inserted into respective slits 33*c* formed on the circuit board 33 so that the case 32 is attached to the circuit board 33.

Figure 7A:
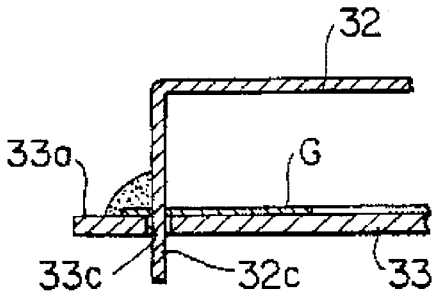
FIG. 7A is a cross sectional view showing a soldered portion of the flat antenna apparatus shown in FIG. 4.
Figure 7B:
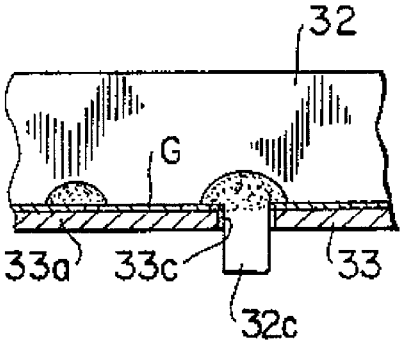
FIG. 7B is a cross sectional view showing another soldered portion of the flat antenna apparatus shown in FIG. 4.

The above-mentioned flat antenna apparatus 30 is assembled in the following manner. First, the coaxial cable 34 is mounted on the circuit board 33, which coaxial cable 34 is connected to the flat antenna element 31 and the circuit board 33. Thereafter, a plurality of tabs 32*c* formed on the edges of the side walls of the case 32 are inserted into the respective slits 33*c* formed on the circuit board 33. The tabs 32*c* are then soldered as shown in FIG. 7A, and the assembling operation of the flat antenna apparatus 30 is finished. The flat antenna element 31 is positioned by the tabs 32*c* protruded from the circuit board 33 as shown in FIG. 5, and attached on the circuit board 33 by an adhesive tape.

According to the above-mentioned embodiment, the circuit board 33 is directly connected to the case 32, that is, it is not placed on top of a mounting board which is made of metal and grounded, as in the prior art. Additionally, electric parts comprising the low-noise amplifier are shielded by being accommodated in the case 32.

Accordingly, if a warp is generated in the circuit board 33, a drift capacity is not generated in the low-noise amplifier because the grounded case 32 is sufficiently apart from the low-noise amplifier. Thus, the possibility that an abnormal oscillation will be generated is eliminated. Additionally, since the number of parts and the number of assembling processes are decreased by eliminating a mounting board made of a metal plate, a low cost flat antenna apparatus can be obtained.

Additionally, since the case 32 is formed in the box-like shape having a one bottom face which is open, a conventional cover is not needed, and thus the number of parts is decreased.

Further, a reliable soldering can be performed with a simple operation because the circuit board 33 is soldered at portions outside the case 32. Additionally, since the ground pattern G is formed in a shape corresponding to the shape of the peripheral walls of the case 32, an additional soldering may be performed at an arbitrary position along the peripheral walls. Accordingly, an external noise can be surely lead to the ground pattern G via the case 32.

In this embodiment, the coaxial cable 34 is fixed on the circuit board 33 by the claws 32*b* formed on the protruding portion 32*a* of the case 32. First, a core wire 34*c* of the coaxial cable 34 is soldered to a connecting portion formed on the circuit board 33. In a state where an outer sheath 34*a* of the coaxial cable 34 is sandwiched between the protruding portion 32*a* of the case 32 and the extending portion 33*b* of the circuit board 33, the pair of claws 32*b* are inserted into the respective slits 33*d* formed on the extending portion 33*b*. An end of each of the claws is then bent inward, and thus the coaxial cable is fixed on the circuit board 33. Preferably, a protrusion 32*d* is formed on an inner surface of each of the claws 32*b*. The protrusions 32*d* are provided to enable the claws 32*b* to be easily bent.

As mentioned above, the cable mounting construction of the present embodiment is simple, and has a smaller number of parts as compared with the conventional apparatus.

Figure 8:
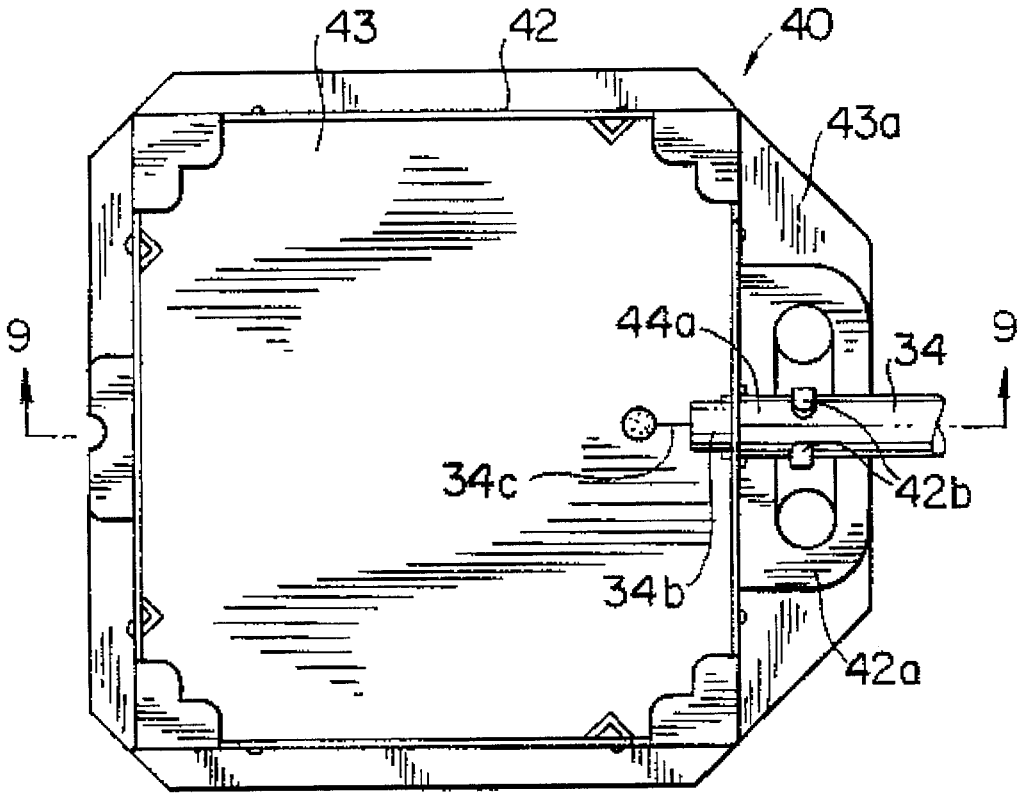
FIG. 8 is a plan view of another embodiment of a flat antenna apparatus according to the present invention.
Figure 9:
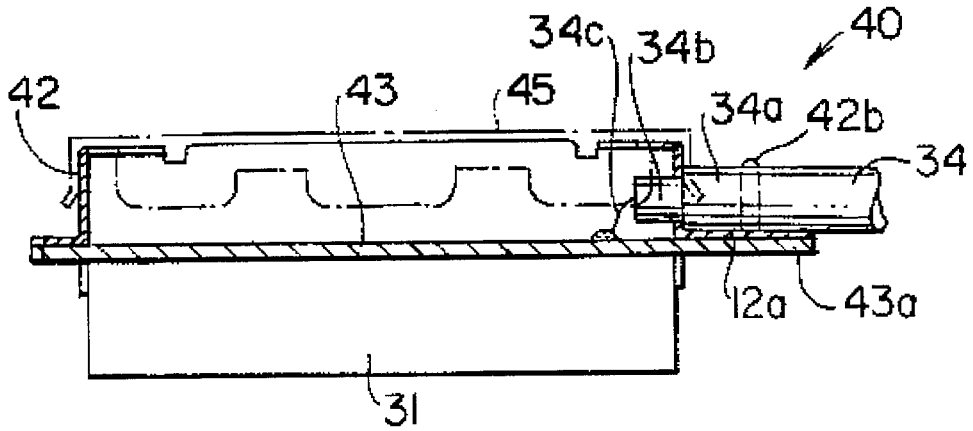
FIG. 9 is a cross-sectional view of the flat antenna apparatus shown in FIG. 8.

A description will now be given of another embodiment of a flat antenna apparatus according to the present invention. FIGS. 8 and 9 show another embodiment of a flat antenna apparatus 40 according to the present invention.

In the flat antenna apparatus 40 shown in FIGS. 8 and 9, a case 42 is open on its upper side as is in the conventional apparatus, the opening being closed with a cover 45. The rest of this embodiment is the same as that of the above-mentioned embodiment except that a cable mounting construction is different from that of the above-mentioned embodiment.

Figure 10:
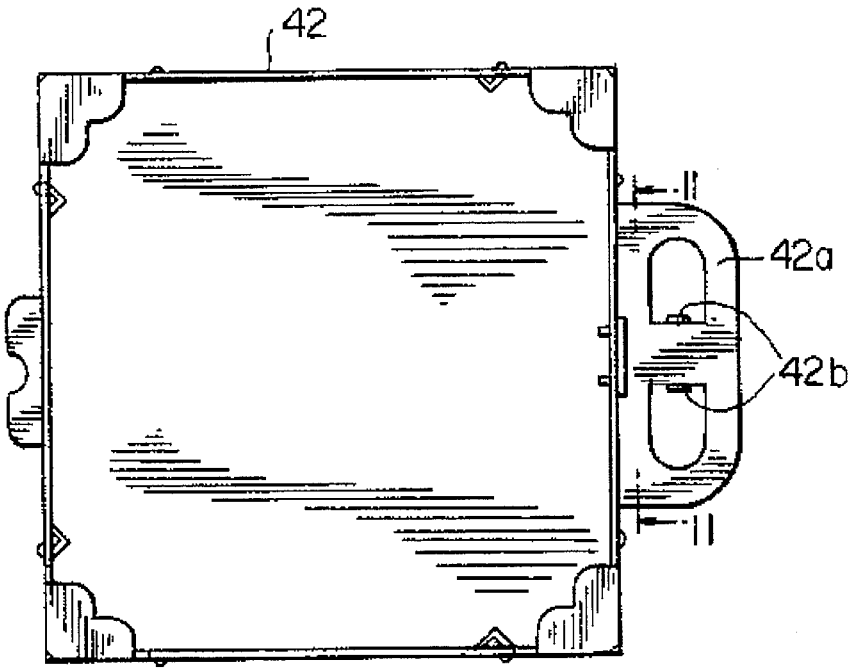
FIG. 10 is a plan view of a cover shown in FIG. 8.
Figure 11:
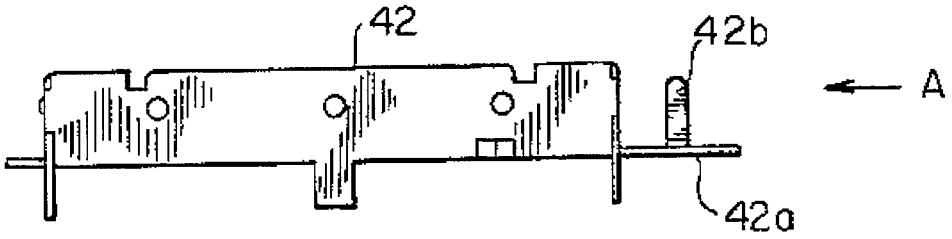
FIG. 11 is a side view of the cover shown in FIG. 8.
Figure 12:
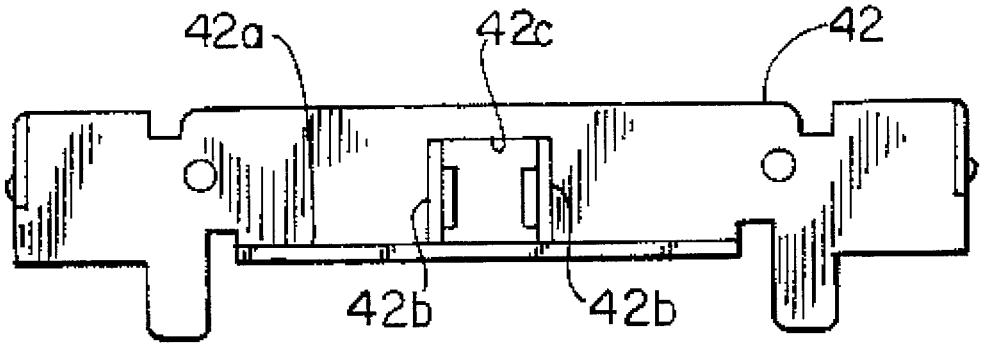
FIG. 12 is a front view of the cover shown in FIG. 8 viewed from a direction indicated by an arrow A of FIG. 11.
Figure 13:
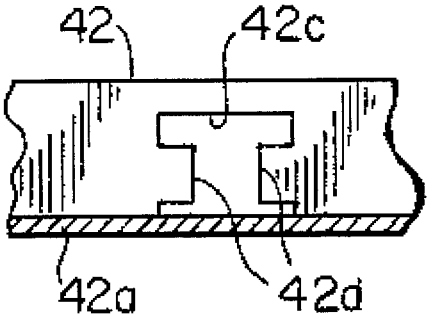
FIG. 13 is an inside view of an opening shown in FIG. 12.

In the flat antenna apparatus 40, a protruding portion 42*a* is formed on a side wall of the case 42 by bending. A pair of claws are formed on the protruding portion 42*a* by cutting and bending. FIGS. 10 and 11 show the case 42. FIG. 12 is a front view viewed from a direction indicated by an arrow A in FIG. 11. An opening 42*c* through which the coaxial cable 34 is passed is formed, as shown in FIG. 12, on the side wall on which the protruding portion 42*a* is formed. FIG. 13 is a view of the opening as viewed from inside the case 42. As shown in FIG. 13, a pail, of bending tabs 42*d* are formed on opposite sides of the opening 42*c*. A distance between the bending tabs is slightly less than a diameter of a shield conductor 34*b* of the coaxial cable 34, and thus the coaxial cable 34 is positioned by being pinched by the bending tabs 42*d*.

In an assembling process of the above-mentioned cable mounting construction, the shielding conductor 43*b* is inserted into the opening 42*c* of the case 42. At this time, the bending tabs 42*d* are elastically bent, and thus the coaxial cable 34 is held by the bending tabs 42*d* and at the same time the shield conductor 34*b* is electrically connected to the case 42. Thereafter, the coaxial cable 34 is fixed on the protruding portion 42*a* of the case 42 by bending the pair of the claws 42*b*. After the case 42 and the circuit board 43 are assembled together, the core wire of the coaxial cable 34 is soldered to the connecting portion of the circuit board 43.

According to the above-mentioned cable mounting construction of the coaxial cable, since the coaxial cable can be fixed to the case by means of a simple construction, the number of parts and the number of assembling processes are decreased, resulting in a reduction in manufacturing costs.

The present invention is not limited to the specifically disclosed embodiments, and variations and modifications may be made without departing from the scope of the present inanition.

What is claimed is:

1. A flat antenna apparatus comprising:

a flat antenna element;

a circuit board having opposite first and second sides and having an amplifying circuit for amplifying a radio frequency received from said flat antenna element, said flat antenna element being directly mounted on said first side of said circuit board and positioned parallel to said circuit board without any electrically conductive material interposed therebetween, said electrically conductive material being separate from said circuit board and said amplifying circuit being formed on said second side of said circuit board;

a case, positioned on said circuit board, being made of an electrical conductor so that said amplifying circuit is shielded; and attaching means for directly attaching said case to said circuit board without a mounting member, wherein said case is attached on an said second side of said circuit board.

2. The flat antenna apparatus as claimed in claim 1, wherein said attaching means comprises at least one tab formed on a peripheral edge of said case and at least one slot formed on said circuit board, said edge contacting said circuit board, said tab being inserted into said slot when said case and said circuit board are assembled together.

3. The flat antenna apparatus as claimed in claim 1, wherein said circuit board has a ground pattern formed in a size larger than an overall size of said edge contacting said circuit board, and said slot is formed within said ground pattern.

4. The flat antenna apparatus as claimed in claim 3, wherein said tab is fixed by means of soldering at a portion of outside said case in a state where said tab is inserted into said slot.

5. The flat antenna apparatus as claimed in claim 3, wherein a portion of said peripheral edge of said case is fixed on said ground pattern by means of soldering.

6. A flat antenna apparatus comprising:

a flat antenna element;

a circuit board having an amplifying circuit for amplifying a radio frequency received from said flat antenna element, said flat antenna element being mounted on said circuit board;

a case, positioned on said circuit board, being made of a conductor so that said amplifying circuit is shielded; and attaching means for directly attaching said case to said circuit board without having a mounting member, wherein said case is attached on an opposite side of said flat antenna element relative to said circuit board, wherein said attaching means comprises at least one tab formed on a peripheral edge of said case and at least one slot formed on said circuit board, said edge contacting said circuit board, said tab being inserted into said slot when said case and said circuit board are assembled together and wherein said tab protrudes from said slot when said case is attached to said circuit board so that said flat antenna element is positioned by a protruded portion of said tab.

7. The flat antenna apparatus as claimed in claim 1, further comprising a connecting cable extending from said case so as to connect said circuit board to an external device, an opening through which said connecting cable is passed being formed on a side wall of said case, a protruding portion extending outwardly along said connecting cable being formed on said side wall, said connecting cable being fastened to said protruding portion.

8. The flat antenna apparatus as claimed in claim 7, wherein said case is formed of a metal plate, and said protruding portion is formed by cutting and bending said side wall of said case.

9. The flat antenna apparatus as claimed in claim 8, wherein said protruding portion has a pair of claws so that said connecting cable is fixed by being pinched by said claws.

10. The flat antenna apparatus as claimed in claim 8, wherein said connecting cable comprises a coaxial cable, and a pair of protrusions are formed on a fringe of said opening so that said protrusions contact and hold a shield conductor of said coaxial cable when said coaxial cable is inserted into said opening.

* * * * *